United States Patent [19]

Putz

[11] Patent Number: 4,800,618

[45] Date of Patent: Jan. 31, 1989

[54] OVERHEAD GARAGE DOOR SELFSEALING DEVICE

[76] Inventor: Helmut J. Putz, 18645 Portland Ave., Gladstone, Oreg. 97027

[21] Appl. No.: 103,676

[22] Filed: Oct. 1, 1987

[51] Int. Cl.[4] ..... E05D 15/16

[52] U.S. Cl. ..... 16/95 R; 16/96 R; 16/DIG. 1; 160/209; 49/197

[58] Field of Search ..... 160/209; 49/197, 199, 49/200; 16/87.2, 87.4 R, 94 R, 94 D, 95 R, 95 W, 96 R, 96 D, 96 L, 97, 99, DIG. 1

[56] References Cited

U.S. PATENT DOCUMENTS

| | | | |
|---|---|---|---|
| 1,985,976 | 1/1935 | Clark | 160/209 |
| 2,166,746 | 7/1939 | Bartel | 49/200 |
| 2,827,114 | 3/1958 | Stroup | 160/209 |

*Primary Examiner*—Richard K. Seidel

[57] ABSTRACT

An overhead tracked door selfsealing device suitable for easy retrofit of existing door installations which have no self sealing feature. It is comprised of a bracket and a spring driven cam system that is attached to the door track at the roller shaft points when the door is in the closed position. As a result, a lateral force imparted by the cam against the roller shaft via the pre-loaded spring forces the door against the jamb.

3 Claims, 1 Drawing Sheet

OVERHEAD GARAGE DOOR SELFSEALING DEVICE

BACKGROUND OF THE INVENTION

Description of Prior Art

The prior art known to the inventor is contained in U.S. Pat. No. 1985976 to Clark, U.S. Pat. No. 2166746 to Bartel, and U.S. Pat. No. 2827114 to Stroup. Each was for an overhead door system, but only those of Clark and Stroup incorporated forcible self sealing as a feature. In each case, retrofit to incorporate these self sealing features on existing overhead tracked door installations could be described as difficult.

SUMMARY OF THE INVENTION

This invention is a device to be used as a retrofit on existing overhead tracked garage door installations which do not have, as part of their designs, a self sealing capability to forcably move the door against the jamb when the door is in the closed position.

This device, when clamped to the door track at the roller shaft, pivots when the door is in the closed position, utilizes the looseness of garage door hardware to forcibly move the door against the jamb by means of a springloaded cam.

Unlike previous sealing methods, this device lends itself to a simple retrofit.

BRIEF DEICRIPTION OF DRAWING

DESCRIPTION OF THE PREFERRED EMBODIMENTS

Figure 1:
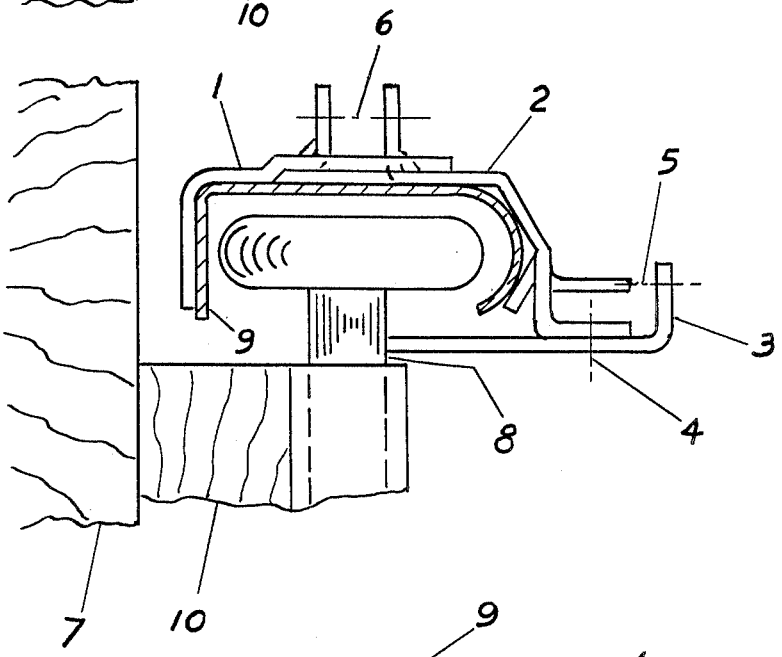
Figure 3:
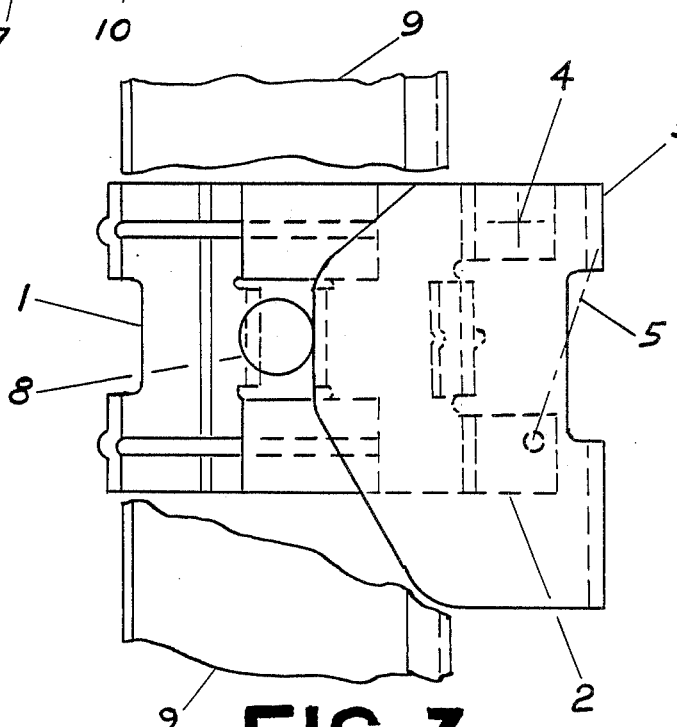
FIG. 3 is a side view of the FIGS. 1 and 2 showing self sealing device attached to the door track at the roller shaft point when the door is in the closed position.
Figure 4:
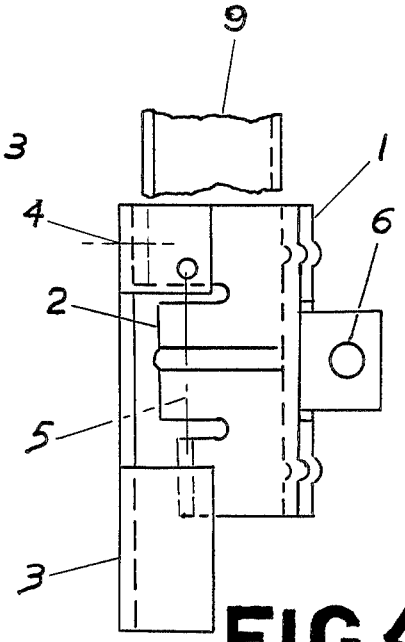
FIG. 4 is a rear view of FIG. 3 showing the self sealing device attached to the door track.

Referring to FIGS. 1, 3, and 4 the device is attached to the door track 9 and forcing the door 10 against the door jamb 7 by means of the spring loaded force of cam

3 against roller shaft 8 supplied by suitable spring 5 when the garage door 10 is in the closed position.

Attachment of the device is made to the track 9 by sandwiching door track 9 between bracket 1 and bracket 2 and tightening screw 6 to provide clamping action. Cam 3 is hinged on bracket 2 by pivot pin 4 and is forced against roller shaft 8 by suitable spring 5 which has one end anchored in cam 3. The force supplied by cam 3 on roller shaft 8 pushes the door 10 against door jamp 7. As door 10 travels upward, cam 3 loses contact with roller shaft 8 and cam 3 contacts and rides up and over the next roller shaft 8 and any other roller shafts 8 to contact it as door 10 continues to travel.

Figure 2:
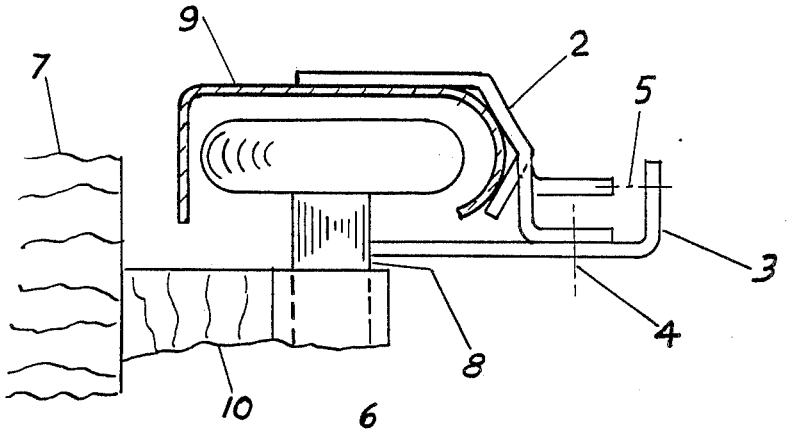
FIGS. 1 and 2 are plan views looking down on the door roller and door track with the selfsealing device attached to the door track at the roller point when the door is in closed position.

Referring to FIG. 2, this is a plan view identical to FIG. 1, except that bracket 1 is not used and bracket 2 is fastened to door track 9 by any suitable means at the roller shaft points with the door in the closed position. Operation of the device as installed per FIG. 2 is identical to the description provided above when referring to FIG. 1.

I claim:

1. An overhead tracked door sealing device which can be retrofitted to existing door installations which do not have such sealing capability, said device comprising bracket means for clamping onto the door track at the roller points when the door is in the closed position, and spring loaded cam means attached to said bracket means for resiliently forcing the door towards the door jamb, thereby sealingly engaging the door with the door jamb.

2. An overhead tracked garage door sealing device which can be retrofitted to existing garage door installations which do not have such sealing capability, said device comprising of a bracket which can be suitably fastened to the garage door tracks at the roller points when the garage door is in the closed position, and spring loaded cam means attached to said bracket means for resiliently forcing the garage door towards the garage door jamb, thereby sealingly engaging the garage door with the garage door jamb.

3. The overhead tracked door sealing device of claim 1 or 2 wherein components of this device are metallic, plastic, or combinations thereof.

* * * * *